US005158188A

United States Patent [19]

Nordberg

[11] Patent Number: 5,158,188

[45] Date of Patent: Oct. 27, 1992

[54] PORTABLE APPARATUS FOR MOVING A PATIENT ABOUT A ROOM

[76] Inventor: Henry T. Nordberg, 510 Lake Rd., Oneida, N.Y. 13421

[21] Appl. No.: 764,235

[22] Filed: Sep. 23, 1991

[51] Int. Cl.[5] ..... A61G 7/14; B66C 17/00

[52] U.S. Cl. ..... 212/209; 212/134; 212/213; 5/81.1; 5/85.1

[58] Field of Search ..... 5/81.1, 83.1, 85.1, 5/86.1, 87.1; 212/209, 205, 218, 134, 213

[56] References Cited

U.S. PATENT DOCUMENTS

| | | | |
|---|---|---|---|
| 1,298,508 | 3/1919 | Jerome et al. | 5/85.1 |
| 2,272,778 | 2/1942 | Reuter | 5/85.1 |
| 2,368,390 | 1/1945 | Winter | 5/86.1 |
| 4,003,479 | 1/1977 | Reyer | 5/86.1 |
| 4,202,064 | 5/1980 | Joergensen | 5/83.1 |
| 4,243,147 | 1/1981 | Twitchell et al. | 212/215 |
| 4,627,119 | 12/1986 | Hachey et al. | 5/83.1 |
| 4,944,056 | 7/1990 | Schroeder et al. | 5/81.1 |

*Primary Examiner*—Alexander Grosz
*Attorney, Agent, or Firm*—Wall and Roehrig

[57] ABSTRACT

An economical portable patient moving system is provided that can be simply and easily erected within a room to form a pipe frame on which is mounted a travelling bridge and hoist trolley allowing complete x,y movement throughout the room and lifting and lowering at any position within the room. The hoist is powered with a battery for safety reasons, and the travelling bridge and hoist car are mounted on low-friction wheel and bearing assemblies so that the entire apparatus can be simply and easily moved about the room by a physically impaired person sitting in the patient carrying platform and moving the feet along the floor to guide the travelling bridge and car members.

10 Claims, 4 Drawing Sheets

PORTABLE APPARATUS FOR MOVING A PATIENT ABOUT A ROOM

BACKGROUND OF THE INVENTION

This invention relates to a simple, economical, and safe apparatus for raising and lowering a patient and moving the patient about a room. More particularly, this invention relates to a travelling hoist apparatus that allows a physically impaired person to move themselves around an entire room and in and out of bed, wheelchair, toilet facilities, lounge chairs and the like.

PRIOR ART

Transfer hoists for disabled persons have been used by paraplegic, quadriplegic, handicapped, weak or elderly persons to transport themselves from one place to another, such as from a wheelchair to a bed, with or without assistance from others. Prior art hoists have commonly been mounted on the ceiling of a room and suspended from overhead rails fixed to ceiling joists.

To obviate the need to secure the hoist system to the room structure, various floor mounted hoist systems have been proposed and used. They usually have involved tripod bases and have been cumbersome, taken up a lot of floor space, and have been inconvenient to use when assistance is required because they "get in the way". Various I-beam and jib-crane type systems have also been proposed, but none of them have been totally satisfactory for maximum flexibility, access, and ease of use throughout the entire area of a patient's room. Most prior art hoist systems have been complicated, expensive to install and operate, and many electrically powered systems have presented unacceptable risks of danger to severely handicapped persons from electrical and mechanical catastrophes.

OBJECTS AND SUMMARY OF THE INVENTION

Accordingly, it is an object of the present invention to overcome the limitations of prior art devices.

It is another object of the present invention to provide a simplified economical and portable patient transporting system that can be readily and simply installed in a wide variety of rooms and moved from room to room as required.

It is yet another object of the present invention to provide a simplified, reliable system for moving a physically impaired person from point A to Point B within their room that allows a person of limited physical strength to move a large heavy person.

It is a further object of the present invention to provide a battery powered hoist system that can be automatically fully recharged when not in use by positioning the hoist system in a predesignated location.

It is another object of the present invention to provide an economical, safe and easy to use patient transporting system for selectively moving a disabled person from bed to toilet facilities to wheelchair to table to recliner and the like.

It is yet another object of the present invention to provide a travelling hoist system for moving of physically impaired persons that requires very little force to overcome the friction of the system and to move the travelling bridge and hoist car easily about for movement of the person throughout the room in which the system is installed.

In one embodiment, this is accomplished by providing a very simplified pipe frame system having a bottom rectangular base positioned around the periphery of the room in which it is to be installed, a corresponding top frame having side and end pipe members supported on four corner posts joined to the lower frame. The upper frame carries thereon a travelling bridge, mounted for rolling movement along the side rails of the frame and a hoist car mounted for transverse movement along the travelling bridge. A battery operated electric hoist is mounted on the hoist car for raising and lowering a support platform for the person to be transported.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF THE INVENTION

Figure 1:
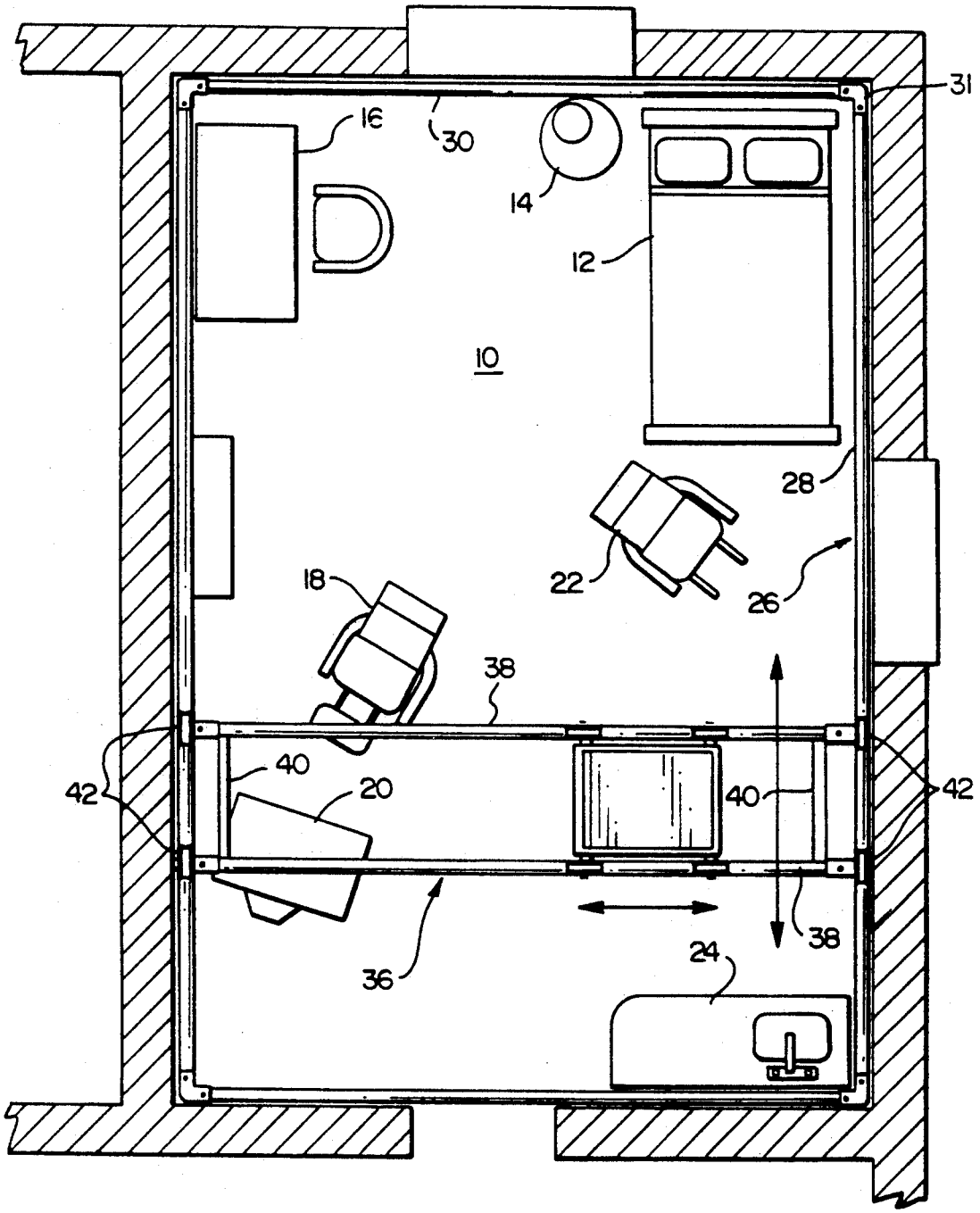
FIG. 1 is a plan view partially in section of a typical room used to house a physically impaired person.

Referring now to FIG. 1 there is shown a room 10 in which is located a bed 12, a toilet facility 14, desk 16, recliner chair 18, television 20, wheelchair 22, and lavatory 24. These are typical items of furniture that will be found in a room used to care for physically disabled persons who are not able to be ambulatory and care for themselves.

Mounted around the ceiling of the room 10 is a pipe frame 26 which consists generally of side frame members 28 and end frame members 30 joined together at the corners by couplings 31. The individual side and end frame members 28 and 30 are chosen to fit comfortably within the room, but when in the assembled position to essentially abut the walls of the room adjacent the ceiling. The frame member 26 at the top is supported on four columns 32, which rest in corner couplings 31 at the bottom of a frame 34 which is identical to frame 26, with side members 28 and end member 30. It is positioned on the floor of the room and forms a base for the overall pipe frame structure. The frame structure defines in essence a box about the outer walls of the room within which the patient transporting device can be maneuvered.

Mounted transversely of the upper frame 26 is a travelling bridge 36 which consists generally of a pair of parallel pipe members 38 and short cross members 40 which form the travelling bridge and have at each end a pair of wheels 42 which are designed to complement the pipe rails 28 and to roll therealong permitting movement of the travelling bridge 36 from one end of the room to the other. The four wheel mounting of the parallel rails 38 forms a strong rigid structure for supporting the hoist mechanism, as will be described herein, and ensures safe operation of the device without any danger of the travelling bridge falling into the room.

Figure 2:
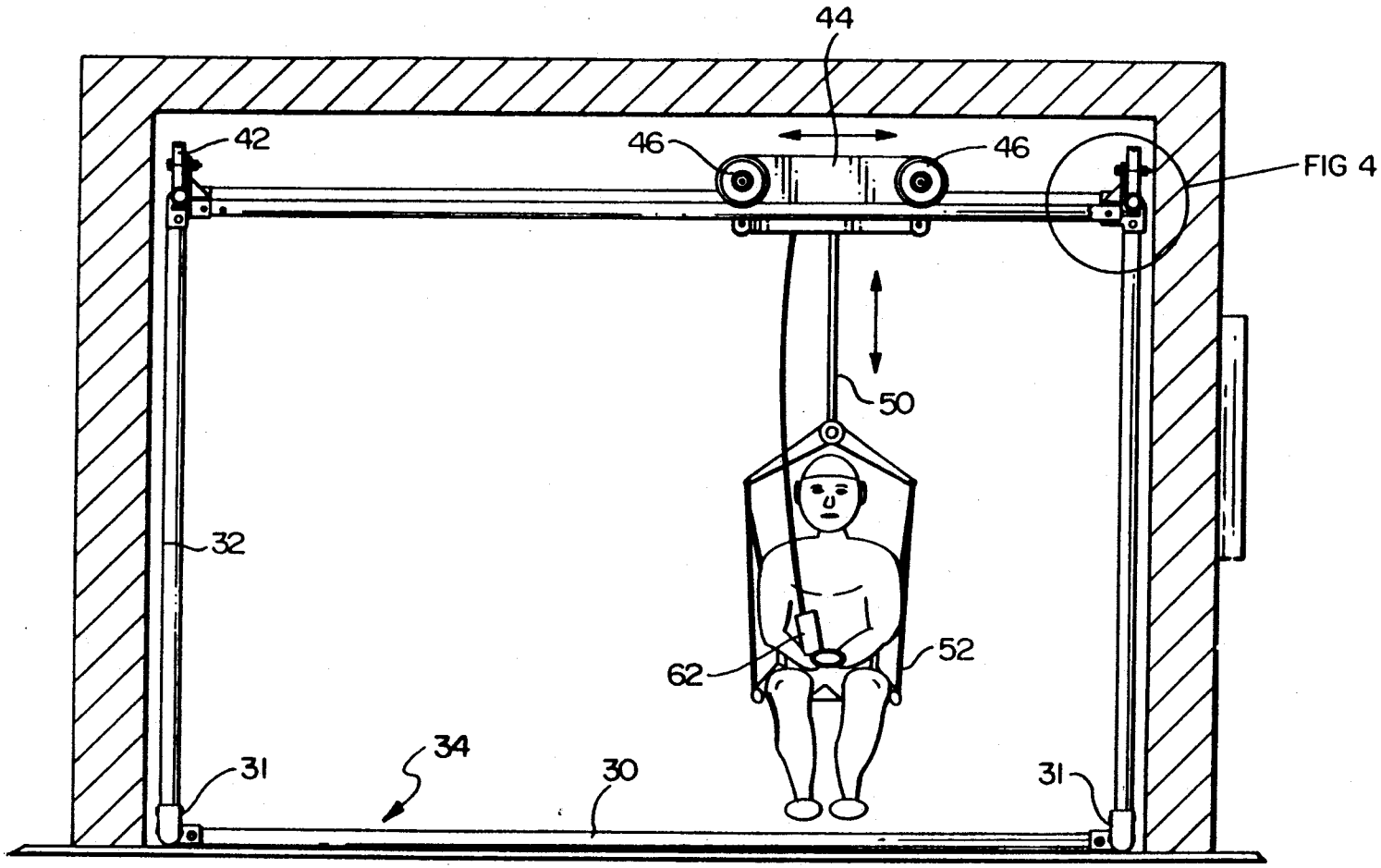
FIG. 2 is an end view partially in section of the hoist system according to the present invention.

Referring now to FIG. 2, it may be seen that the top rails 28 and 30 of the top frame member 26 are spaced downwardly from the ceiling a distance sufficient to accommodate a hoist car 44, which carries the hoist mechanism and the battery power pack for operating same. The car 44 is mounted on a pair of wheels 46 at each side which wheels are similar in configuration to the wheels of the travelling bridge and which ride back and forth on the rails 38 in a direction transversely to that of the movement of the travelling bridge 36. The car 44 carries a hoist motor and drum 48 from which is suspended, by cable 50, a patient lifting platform 52. Platform 52 may take the form of a sling or a chair or other device useful in lifting a physically impaired person from bed or chair to another piece of furniture within the room. As may be seen in FIG. 6, the hoist motor 48 is powered from a battery 54 which is mounted on the car 44 and carried therein. The battery is connected to a control box 56 which has a circuit going to a recharging connector 58 and a control cable 60 which extends down through a hole in the car base to a hand control 62 (FIG. 2) which the patient can use to control operation of the device.

Since the travelling bridge 36 can move from one end of the room to the other, and since the hoist car 44 can move from one side of the room to the other on the rails of the travelling bridge, the patient support platform 52 can be positioned virtually anywhere it is desired throughout the room within the pipe frame enclosure 26.

Figure 4:
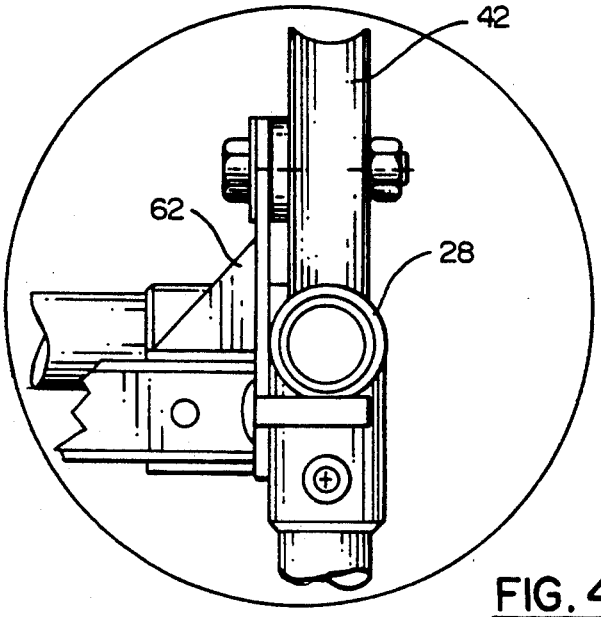
FIG. 4 is an enlarged scale partial view of the pipe and bridge roller mounting.

As indicated above, the pipe frame members 28 and 30 in the top and bottom frame portions of the box frame structure are joined together by couplings 31 which comprise generally a casting having three mutually perpendicular bores therein adapted to receive the pipe frame members 28, 30 and the post 32 as the box frame is assembled within the room. Each pipe member is secured within its respective receptacle in the coupling 31 by a pair of set screws, as will be described in more detail herein. The couplings 31 and pipe rail members 28 and 30 are sized to fit within the room conveniently as indicated above and to allow the frame apparatus to be erected and dismantled quickly and easily with a few simple tools. The travelling bridge 36 is constructed similarly out of two pipe rails 38 and the end cross members 40 and mounting brackets for the end wheels 42 on each end of the travelling bridge. This allows the travelling bridge 36 to move along the length of the side rails 28 of the top frame by rotation of the wheels 42 which are carried on the end bracket 62 at each end of the travelling bridge. As can be seen, (FIG. 4) wheels 42 have a diameter of several times that of the pipe 28 on which they ride and the circumference is concave to provide a tracking and guiding along the pipe. These wheels are mounted on low friction bearings so that it takes very little force to move the travelling bridge along the frame length. This is important because so many physically impaired people who would use this have very little strength in their bodies to move difficult or heavy objects.

While some systems have sought to power the movement of the travelling bridge 36 and the movement of the hoist car 44, applicant believes that it is better to reduce friction and make the apparatus movable with a very minimum of force so that the patient can move him or herself by shuffling their feet along the floor in appropriate fashion. I believe this is not only a much cheaper system, but it is much safer in that there is less high-power electricity within the frame, it makes the device much simpler and lighter to set up and take down, and it allows the patient to move at their own convenience and pace within the room.

Figure 6:
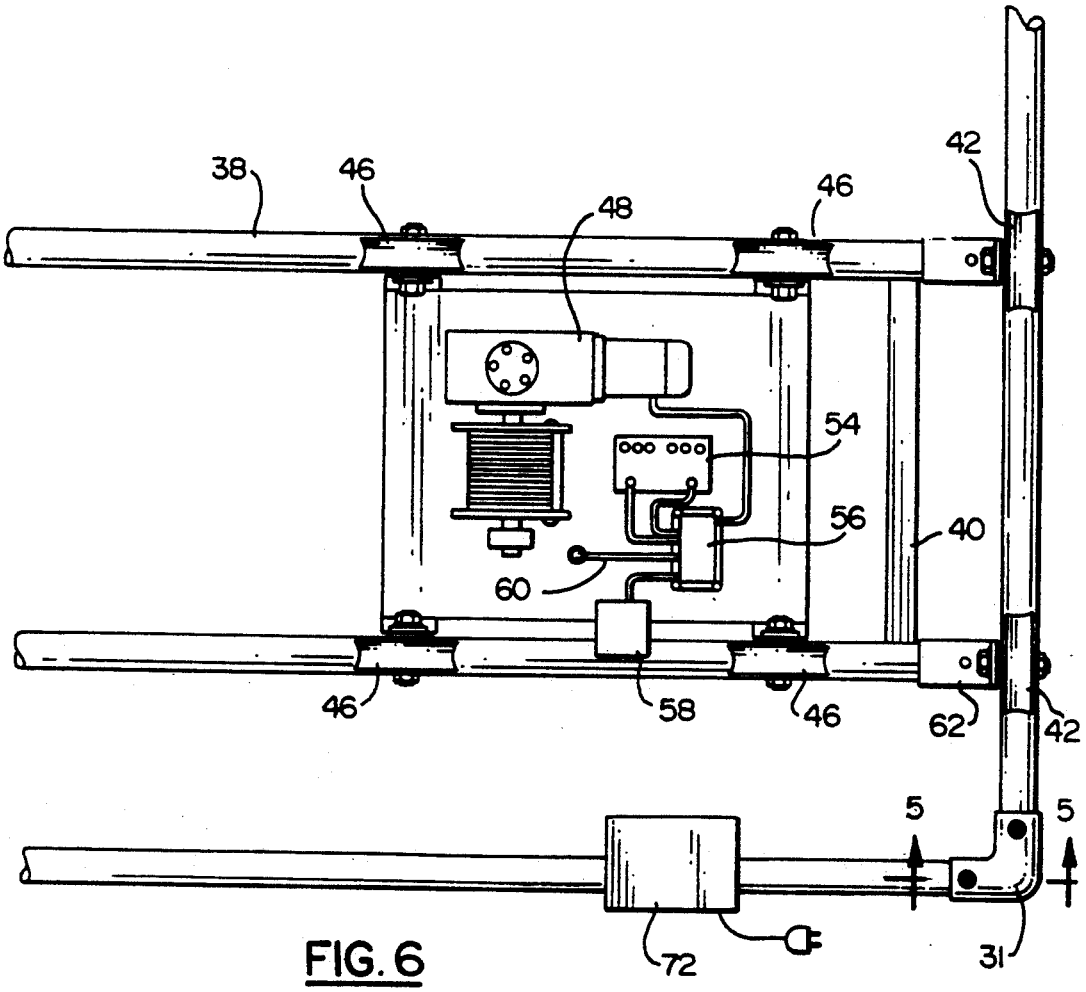
FIG. 6 is a partial top plan view of the hoist car and charging circuit connector configuration for the hoist batteries.

As may also be seen in FIG. 6, the hoist car 44 is mounted on two pair of wheels 46 which again are sized and contoured to reduce rolling friction along the guide rails 38 for the hoist car as it moves therealong. Again, the movement is controlled by the patient moving their feet in the desired direction.

The hoist car 44 has mounted on one side, as previously described, a receptacle 58 for connecting charging power to the battery 54. The receptacle 58 may be either male or female and it is arranged to cooperatively engage with a corresponding receptacle 72 which is mounted on an end top frame member 30, adjacent a corner so that when the car is moved fully to one limit of the travelling bridge and the travelling bridge is moved to the end of the room, the receptacle 58 can plug into the receptacle 72 to make good electrical contact with charging current for recharging the battery. Thus, the only time that 110 or 220 volt power will be connected to the hoist car and travelling bridge will be when the apparatus is not in use and the travelling bridge and car are parked in the corner for recharging.

In operation, the patient lifting platform 52, which will be configured to accommodate the degree of mobility that the patient still has and is used to lift the patient from the bed 12, for instance to the toilet facility 14 or to the lavatory 24 or the wheelchair 22, as the case may be. Once the patient has been placed in the seat 52 and the controls made available, the patient can control his or her own movement throughout the x,y axis of the room and can, if physically able, transfer from the lifting platform 52 to the TV chair 18, for instance, or other furniture items, as desired. Because of the very low rolling friction of the travelling bridge and the hoist car, the patient can easily move from one point in the room to another by shuffling along the floor with their feet. Since the hoist mechanism is battery powered, the maximum voltage that can possibly be applied to the patient lifting chair would be the twelve volts of the hoist battery instead of the usual 110 or 220 found in many of the earlier prior art devices. This makes the system very safe and extremely difficult for even a physically impaired person to accidentally be injured by electrical shock. This also allows an economical lifting DC motor to be used which can be controlled quite readily for lifting and lowering of the patient and which can also have a mechanical override in case of premature battery failure so as to allow the patient to be rescued from a suspended position or raised to a position sufficient to gain access to the bed.

It thus is apparent that I have provided a very economical, simple, portable patient lifting and moving device which can be quickly and easily installed in a room and which can be quickly broken down and moved to another room should the situation require. The device is completely free-standing so that no interconnection with the building itself is required, other than to plug in the battery charging unit into an electrical outlet. Physical damage to the room interior is eliminated by careful installation of the device, and since all bearing and weight carrying functions are handled entirely by the box frame structure, no reinforcing or special structural modifications to the building need to be made.

Figure 3:
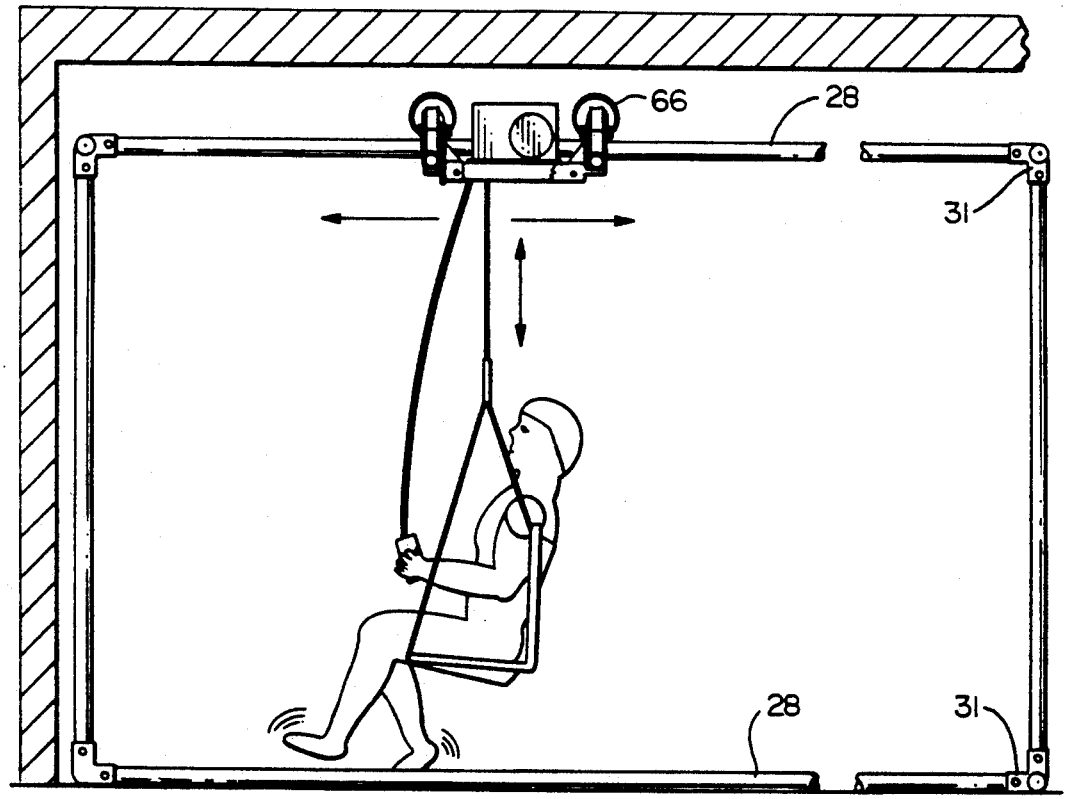
FIG. 3 is a view similar to FIG. 2 taken at 90° thereto.

While I have shown a particular patient lifting platform 52, various types of patient slings come to mind adapted for particular physical impairments and for different functional uses. Specialized lifting slings for toilet use can be provided in which the patient does not have to be lifted out of the chair device in order to avail themselves of the use of the facility. A stable platform must be provided for the physically impaired and one such situation is shown in FIGS. 2 and 3. If desired, other supporting arrangements can be provided from the hoist car 44, including hoisting platforms for a patient in sitting, standing or prone position.

Figure 5:
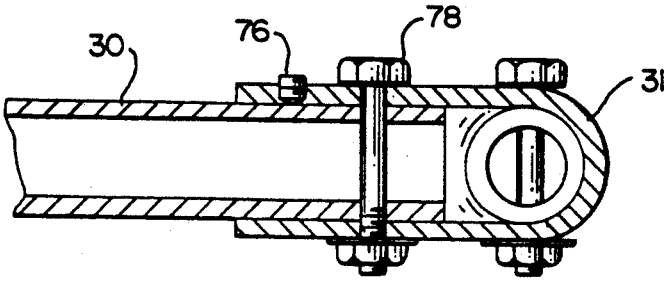
FIG. 5 is a partial sectional view of the fastening of a coupling to the pipe rails.

Referring now to FIG. 5, there is shown a connection between the coupling 31 and a pipe 30 in which the pipe is inserted into the socket within the coupling 31 and a set screw 76 is inserted to hold the pipe 30 in place in the coupling 31. As the frame is completely assembled about the room and the platform is positioned in the desired configuration, each pipe and coupling can be safety secured to the coupling by use of a bolt 78 or other type of threaded set screw which actually physically penetrates both the pipe and the coupling to join them together and provide the double safety lock feature. This permits not only the fast and easy erection and disassembly of the frame system, but ensures integrity such that a physically impaired person using the apparatus does not have to worry about it coming apart or otherwise becoming disengaged and stranding the patient in an undesired position.

While this invention has been explained with reference to the structure disclosed herein, it is not confined to the details set forth and this application is intended to cover any modifications and changes as may come within the scope of the following claims:

What is claimed is:

1. An economical portable patient transport system for moving a physically impaired person about a room which comprises:

a pipe box frame having a rectangular bottom frame portion having side and end pipe members, a corresponding rectangular top frame and four upright corner posts supporting said top frame above said bottom frame adjacent the ceiling of the room in which the system is to be installed;

said frame members being sized to fit about the periphery of the room in which the system is to be installed so as to allow maximum movement within the confines of the room; said side pipe members, said end pipe members, and said corner posts being releasably attached to each other;

a pair of pipe rails extending perpendicularly between the side pipe members of the top frame to from a bridge member;

said bridge member being mounted on a pair of wheels at each end thereof;

said pairs of wheels being positioned to roll along the side pipe members of the top frame from one end of the room to the other;

a hoist car having a pair of wheels at each side positioned to roll along said pair of pipe rails as said car is moved from side to side of the room;

a patient seat platform;

a battery powered hoist means mounted on said car and connected to said patient seat platform for raising and lowering thereof;

control means operatively connected to said hoist means for raising and lowering said hoist, said control means being positioned adjacent the seat platform;

said pairs of wheels on said hoist car and said bridge member having a concave cross section circumference and a diameter at least three times larger than the diameter of the pipe rail or pipe member it is positioned to roll on;

so that the hoist car and said pair of pipe rails can be moved along said pipe rails and side pipe members of the top frame respectively with minimal effort by a patient seated on said seat platform by a shuffling foot action.

2. A portable patient transport system according to claim 1 further including a plurality of three-way right angle couplings joining said side and end pipe members at the corners of the room;

the four upright corner posts positioned at the bottom end in said three-way couplings and carrying at the top end a similar three-way coupling; said right angle couplings being formed to receive therein a side pipe member; and end pipe member and a corner post in mutually perpendicular relation and having set screw means for securing pipe member and corner post ends therein.

3. An economical, portable, patient moving system for moving a physically impaired person about a room comprising in combination:

a pipe box frame having a rectangular bottom frame portion having side and end pipe members, a corresponding rectangular top frame and four upright corner posts supporting said top frame above said bottom frame adjacent the ceiling of the room in which the system is to be installed, said side pipe members, said end pipe members and said corner posts being releasably attached to each other;

said frame members being sized to fit about the periphery of the room in which the system is to be installed so as to allow maximum movement within the confines of the room;

a rectangular bridge member extending transversely from side to side of said pipe box frame having a pair of wheels mounted at each end for rolling contact with said top frame side members for rolling movement therealong;

a pair of parallel pipe rails on said bridge member extending from side member to side member of said box frame;

a hoist car mounted on said bridge pair of pipe rails having a pair of wheels on each side for movement transversely of the movement of the bridge along the pipe box frame;

hoist means mounted on said car; and a patient carrying platform connected to said hoist means for raising and lowering thereof;

so that said platform may be positioned anywhere within said room inside said pipe box frame.

4. A portable patient transport system according to claim 3 further including a plurality of pipe couplings each having three mutually perpendicular hollow pipe receptacles, and said pipe box frame is formed by connecting the top frame members and corner posts together and said bottom frame members and post bottoms together with said pipe couplings so that the system can be easily assembled and disassembled.

5. A portable patient transport system according to claim 4 wherein said couplings comprise a corner member having three hollow cylindrical receptacle portions disposed in mutually perpendicular relationship to receive therein said pipe and post members; and redundant set screw fastening means formed in said couplings for securing said pipe members therein to prevent accidental disassembly.

6. A portable patient transport system according to claim 4 further including a battery connected to said hoist means so that the patient can raise and lower the platform without danger of electrical shock.

7. A portable patient transport system according to claim 6 wherein said bridge and hoist car wheels are of large diameter versus the pipe diameter of the frame so that rolling friction is minimized and the platform can be easily positioned within said box frame.

8. A portable patient transport system according to claim 7 wherein said wheels are mounted on low friction bearings so that the patient can move the platform about by limited foot pressure on the floor.

9. A portable patient transport system according to claim wherein said wheels have a concave cross section circumference for tracking on the top pipe members of the top frame portion and the pipe rails of the bridge member.

10. A portable patient transport system according to claim 6 further including a battery charging means mounted adjacent said battery and operatively connected thereto;

first connector means operatively connected to said charging means mounted on one side of said hoist car so as to extend outwardly therefrom;

second connector means, operatively connected to a source of battery charging electricity, mounted on one end box frame member;

said second connector means extending inwardly from said end frame means so as to mate with said first connector means when said bridge and car are positioned adjacent the frame corner on which said second connector is mounted.

* * * * *